US009682559B2

(12) United States Patent
Ikeuchi et al.

(10) Patent No.: US 9,682,559 B2
(45) Date of Patent: Jun. 20, 2017

(54) CHANNEL MEMBER, LIQUID EJECTING HEAD, RECORDING DEVICE, AND METHOD FOR MANUFACTURING CHANNEL MEMBER

(71) Applicant: Kyocera Corporation, Kyoto-shi, Kyoto (JP)

(72) Inventors: Wataru Ikeuchi, Kirishima (JP); Chitoshi Ueki, Kirishima (JP); Akinori Hirashima, Kirishima (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 15/158,403

(22) Filed: May 18, 2016

(65) Prior Publication Data

US 2016/0279940 A1 Sep. 29, 2016

Related U.S. Application Data

(63) Continuation of application No. PCT/JP2015/074461, filed on Aug. 28, 2015.

(30) Foreign Application Priority Data

Mar. 26, 2015 (JP) ..... 2015-064649

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2/1623* (2013.01); *B41J 2/1626* (2013.01); *B41J 2002/14241* (2013.01); *B41J 2002/14362* (2013.01); *B41J 2202/11* (2013.01)

(58) Field of Classification Search
CPC ..... B41J 2/1623
See application file for complete search history.

(56) References Cited

U.S. PATENT DOCUMENTS 6,422,686 B1 * 7/2002 Ishinaga ..... B41J 2/14024 347/47
9,440,441 B2 * 9/2016 Donning ..... B41J 2/14024
(Continued)

FOREIGN PATENT DOCUMENTS

JP 2006-187967 A 7/2006

OTHER PUBLICATIONS

International Search Report (Form PCT/ISA/210) mailed on Nov. 10, 2015 and issued for PCT Application No. PCT/JP2015/074461.

*Primary Examiner* — Shelby Fidler
(74) *Attorney, Agent, or Firm* — Volpe and Koenig, P.C.

(57) ABSTRACT

[Object] An object of the present invention is to provide a channel member for a liquid ejecting head with small variations in ejection characteristics, a liquid ejecting head including the channel member, and a recording device.
[Solution] A channel member 4 for a liquid ejecting head according to the present invention includes a plurality of plates 4*a* to 4*k* that include a hole or a groove and that are stacked together with an adhesive layer 18 interposed therebetween. The hole or the groove constitutes a channel. The plate 4*e* includes a receiving groove 17 for an adhesive, and an edge of the receiving groove 17 includes a first projection 17*a* that projects from a principal surface of the plate that includes the receiving groove 17.

17 Claims, 6 Drawing Sheets

(56) References Cited

U.S. PATENT DOCUMENTS

| | | | | |
|---|---|---|---|---|
| 2002/0024568 | A1* | 2/2002 | Ito | B41J 2/14209 347/84 |
| 2002/0042994 | A1* | 4/2002 | Ito | B41J 2/1609 29/890.1 |
| 2002/0163563 | A1* | 11/2002 | Blair | B41J 2/1404 347/65 |
| 2004/0164837 | A1* | 8/2004 | Fujita | H02K 1/146 336/234 |
| 2005/0018018 | A1* | 1/2005 | Aschoff | B41J 2/1623 347/63 |
| 2006/0164467 | A1* | 7/2006 | Shibuya | B41J 2/1433 347/70 |
| 2008/0303884 | A1* | 12/2008 | Miura | B41J 2/14274 347/93 |
| 2015/0145908 | A1* | 5/2015 | Rivas | B41J 2/14024 347/9 |

* cited by examiner

CHANNEL MEMBER, LIQUID EJECTING HEAD, RECORDING DEVICE, AND METHOD FOR MANUFACTURING CHANNEL MEMBER

TECHNICAL FIELD

The present invention relates to a channel member, a liquid ejecting head, a recording device, and a method for manufacturing the channel member.

BACKGROUND ART

A known example of a liquid ejecting head is an inkjet head that performs various types of printing by, for example, ejecting liquid toward a recording medium. A liquid ejecting head includes a channel member provided with ejection holes, compression chambers, and common channels. A known channel member includes a plurality of metal plates that are stacked together, the metal plates having holes and grooves that constitute channels. The metal plates are bonded together with an adhesive. The metal plates have receiving grooves for receiving the adhesive to reduce the amount of adhesive that flows into the holes and grooves (see, for example, PTL 1).

CITATION LIST

Patent Literature

PTL 1: Japanese Unexamined Patent Application Publication No. 2006-187967

SUMMARY OF INVENTION

Technical Problem

Even when the adhesive receiving grooves described in PTL 1 are provided, if the thickness of the adhesive layers that remain between the plates is reduced due to, for example, variations in manufacturing conditions, the amount of adhesive that enters the channels increases. As a result, there is a risk that the ejection characteristics, such as the amount of ejection and ejection speed, will vary or clogging of the channels will occur.

Accordingly, an object of the present invention is to provide a channel member, a liquid ejecting head, a recording device, and a method for manufacturing the channel member with small variations in ejection characteristics.

Solution to Problem

A channel member according to the present invention includes a plurality of plates that include a hole or a groove and that are stacked together with an adhesive layer interposed therebetween, the hole or the groove constituting a channel. At least one of the plates includes a receiving groove for an adhesive, and an edge of the receiving groove includes a first projection that projects from a principal surface of the at least one of the plates that includes the receiving groove.

A liquid ejecting head according to the present invention includes the channel member and a plurality of compressing portions. The channel member includes a plurality of ejection holes that are connected to the channel, and the plurality of compressing portions cause the liquid to be ejected from the plurality of ejection holes by compressing the liquid in the channel.

A recording device according to the present invention includes the liquid ejecting head, a conveying unit that conveys a recording medium relative to the liquid ejecting head, and a control unit that controls the liquid ejecting head.

A method or manufacturing a channel member according to the present invention includes a first step of preparing a plurality of plates including a hole or a groove, the hole or the groove constituting a channel; and a second step of supplying an adhesive to a space between the plurality of plates and bonding the plurality of plates together. At least one of the plurality of plates prepared in the first step includes a receiving groove for the adhesive, and an edge of the receiving groove includes a first projection that projects from a principal surface of the at least one of the plates that includes the receiving groove.

Advantageous Effects of Invention

With the liquid ejecting head according to the present invention, variations in liquid ejection characteristics can be reduced.

DESCRIPTION OF EMBODIMENTS

Figure 1A:
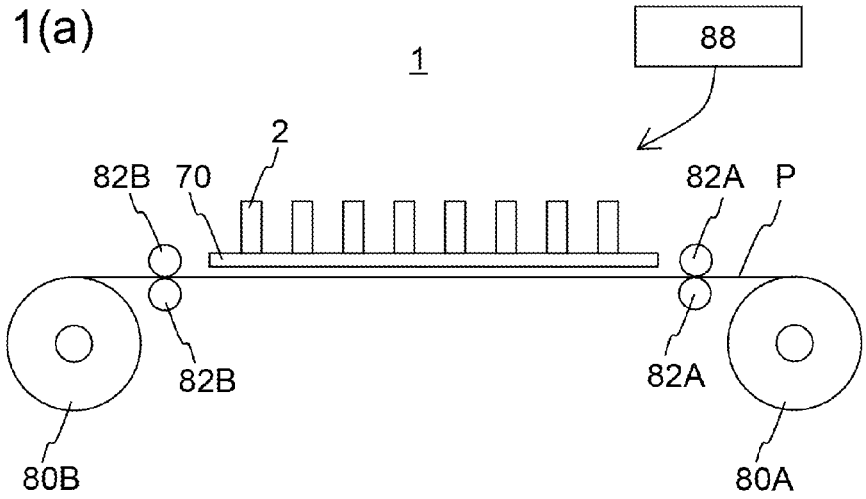
FIGS. 1(*a*) and 1(*b*) are a side view and a plan view, respectively, of a recording device including liquid ejecting heads according to an embodiment of the present invention.
Figure 1B:
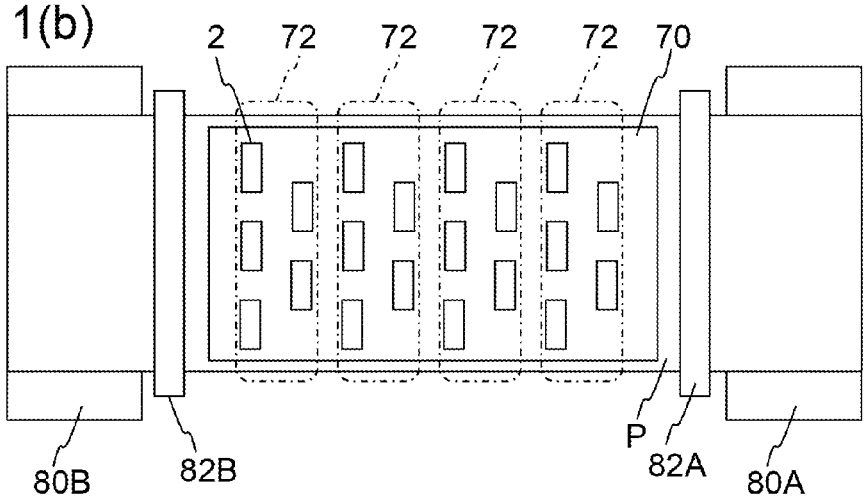

FIGS. 1(*a*) and 1(*b*) are a schematic side view and a schematic plan view, respectively, of a color inkjet printer 1 (hereinafter sometimes referred to simply as a printer), which is a recording device including liquid ejecting heads 2 according to an embodiment of the present invention. The printer 1 moves a print sheet P, which is a recording medium, relative to the liquid ejecting heads 2 by conveying the print sheet P from guide rollers 82A to conveying rollers 82B. A control unit 88 controls the liquid ejecting heads 2 on the basis of image and character data so that the liquid ejecting heads 2 eject liquid toward the recording medium P. Recording, such as printing, is performed on the print sheet P by applying liquid droplets to the print sheet P.

In the present embodiment, the liquid ejecting heads 2 are fixed to the printer 1. The printer 1 is a line printer. A recording device according to another embodiment of the present invention may be a serial printer in which an operation of moving the liquid ejecting heads 2 in a direction that crosses a conveying direction of the print sheet P, for example, in a direction substantially orthogonal to the conveying direction, and an operation of conveying the print sheet P are alternately performed.

A flat plate-shaped head mounting frame 70 (hereinafter sometimes referred to simply as a frame) is fixed to the printer 1 such that the frame 70 is substantially parallel to the print sheet P. The frame 70 has twenty holes (not shown), and twenty liquid ejecting heads 2 are placed in the holes in such a manner that portions of the liquid ejecting heads 2 from which the liquid is ejected face the print sheet P. The distance from the liquid ejecting heads 2 to the print sheet P is, for example, about 0.5 to 20 mm. Every five liquid ejecting heads 2 form a single head group 72; accordingly, the printer 1 includes four head groups 72.

The liquid ejecting heads 2 have a long and narrow shape that extends in a direction from the near side toward the far side in FIG. 1(*a*), which is a vertical direction in FIG. 1(*b*). The direction in which the liquid ejecting heads 2 extend may be referred to as a long-side direction. In each head group 72, three liquid ejecting heads 2 are arranged in a direction that crosses the conveying direction of the print sheet P, for example, in a direction substantially orthogonal to the conveying direction. The remaining two liquid ejecting heads 2 are arranged at locations shifted from the three liquid ejecting heads 2 in the conveying direction, and each of the two liquid ejecting heads 2 is disposed between the three liquid ejecting heads 2. The liquid ejecting heads 2 are arranged such that printable areas thereof are connected to each other, or overlap at the ends, in the width direction of the print sheet P (direction that crosses the conveying direction of the print sheet P). Thus, an image that is continuous in the width direction of the print sheet P can be printed.

The four head groups 72 are arranged in the conveying direction of the recording sheet P. Each liquid ejecting head 2 receives liquid, for example, ink, from a liquid tank (not shown). The liquid ejecting heads 2 belonging to each head group 72 receive ink of the same color, so that the four head groups 72 are capable of performing printing by using inks of four colors. The colors of inks ejected from the head groups 72 are, for example, magenta (M), yellow (Y), cyan (C), and black (K). Color image printing can be performed by using these inks under the control of the control unit 88.

If monochrome printing is to be performed over an area within a printable area of a single liquid ejecting head 2, the number of liquid ejecting heads 2 to be mounted on the printer 1 may be one. The number of liquid ejecting heads 2 belonging to each head group 72 and the number of head groups 72 may be changed as appropriate depending on the printing subject and printing conditions. For example, the number of head groups 72 may be increased to increase the number of colors that can be printed. When a plurality of head groups 72 that perform printing in the same color are provided and caused to perform printing alternately in the conveying direction, the conveying speed can be increased without changing the performance of the liquid ejecting heads 2. In this case, the print area per unit time can be increased. Alternatively, a plurality of head groups 72 that perform printing in the same color may be arranged at locations shifted from each other in a direction that crosses the conveying direction to increase the resolution in the width direction of the print sheet P.

Instead of performing printing by using colored ink, surface treatment for the print sheet P may be performed by applying liquid such as a coating agent to the print sheet P.

The printer 1 prints on the print sheet P, which is a recording medium. The print sheet P is wound around a feed roller 80A. The print sheet P passes through the space between the two guide rollers 82A, the space below the liquid ejecting heads 2 mounted on the frame 70, and the space between the two conveying rollers 82B, and is finally wound around a take-up roller 80B. In a printing operation, the conveying rollers 82B are rotated so that the print sheet P is conveyed at a constant speed, and the liquid ejecting heads 2 performs printing. The print sheet P conveyed by the conveying rollers 82B is wound around the take-up roller 80B. The conveying speed is, for example, 75 m/min. Each roller may be controlled either by the control unit 88 or manually by a user.

The recording medium may be a roll of cloth instead of the print sheet P. The printer 1 may convey the recording medium by placing the recording medium on a conveying belt and directly moving the conveying belt instead of directly conveying the print sheet P. In this case, a cut sheet, a cut piece of cloth, a wood piece, a tile, etc., may be used as the recording medium. The liquid ejecting heads 2 may eject liquid containing conductive powder to print, for example, a wiring pattern of an electronic device. Alternatively, the liquid ejecting heads 2 may eject a predetermined amount of liquid chemical agent or liquid containing a chemical agent toward a reaction chamber to create a reaction for producing a chemical.

Position sensors, speed sensors, temperature sensors, etc., may be attached to the printer 1. The control unit 88 may control each part of the printer 1 in accordance with the states of the parts of the printer 1 that can be determined from information obtained by the sensors. For example, when the temperature of the liquid ejecting heads 2, the temperature of the liquid in the liquid tank, and the pressure applied to the liquid ejecting heads 2 by the liquid in the liquid tank affect the ejection characteristics, such as the amount of liquid that is ejected and the ejection speed, driving signals used to eject the liquid may be changed in accordance with these pieces of information.

Figure 2:
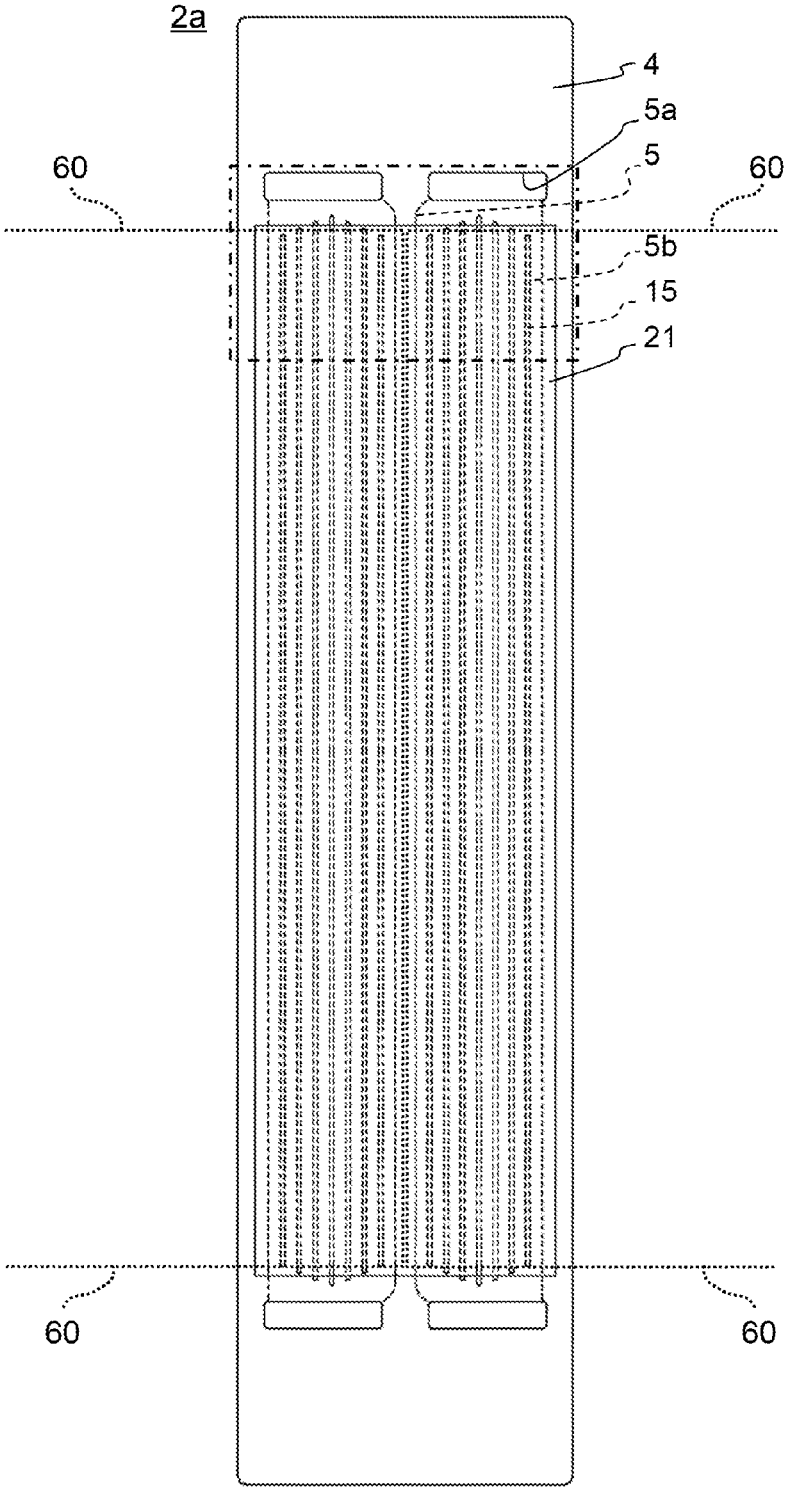
FIG. 2 is a plan view of a head body, which is a main portion of each liquid ejecting head in FIG. 1.
Figure 3:
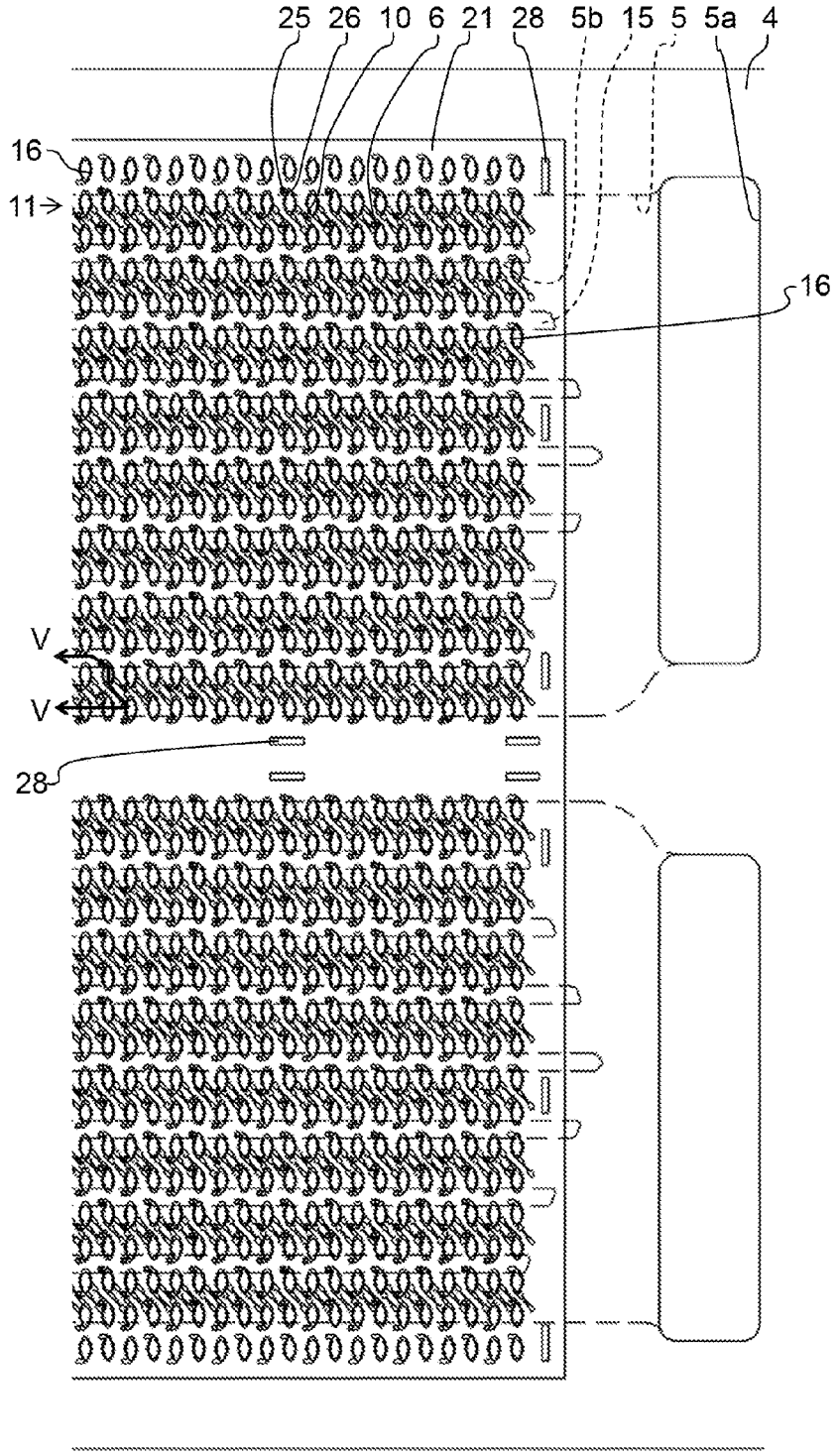
FIG. 3 is an enlarged view of the region enclosed by the dotted-chain line in FIG. 2, where some channels are omitted to simplify the description.
Figure 4:
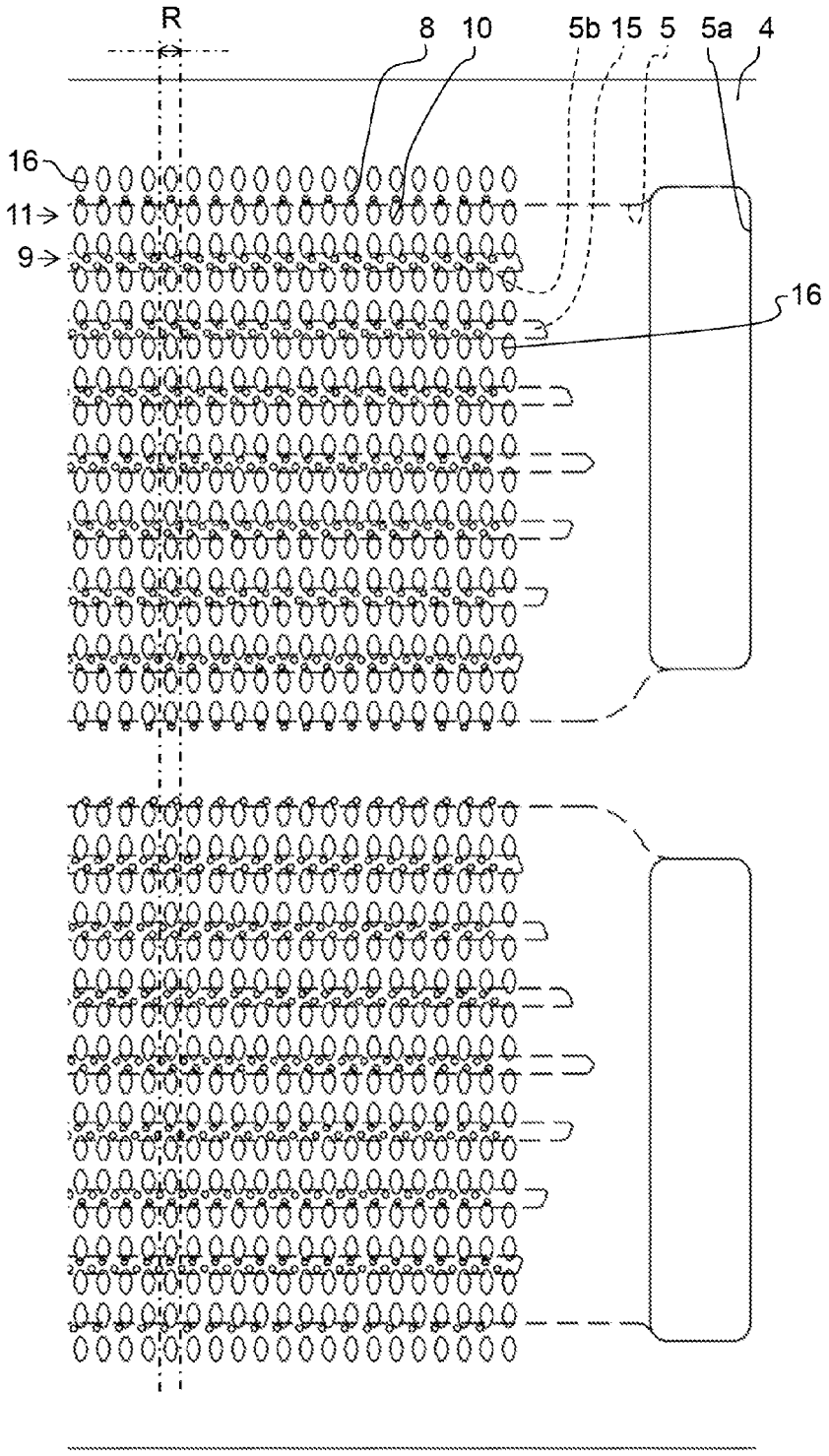
FIG. 4 is an enlarged view of the region enclosed by the dotted-chain line in FIG. 2, where some channels are omitted to simplify the description.
Figure 5:
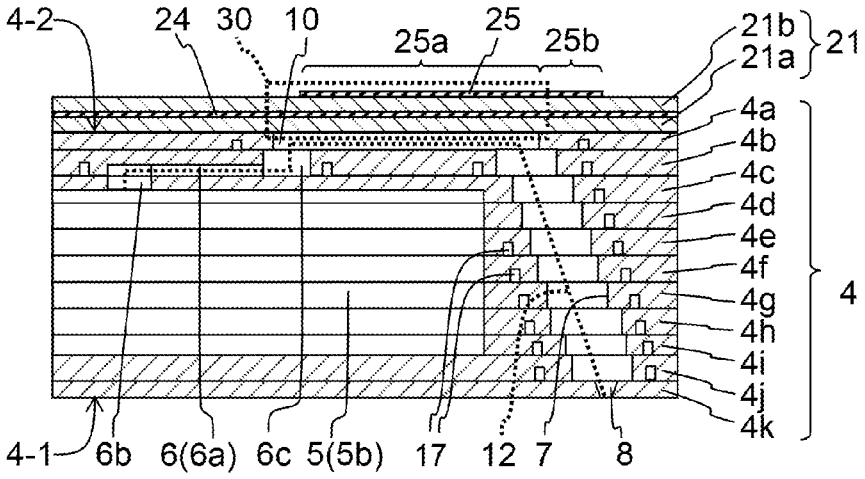
FIG. 5 is a longitudinal sectional view taken along line V-V in FIG. 3.
Figure 6A:
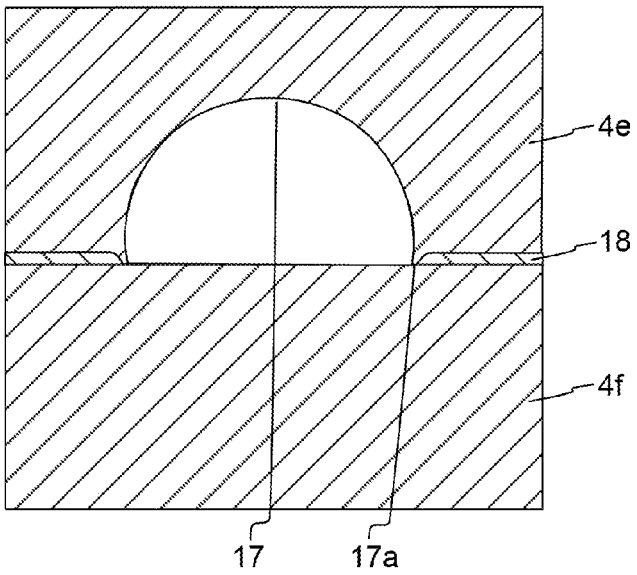
FIG. 6(*a*) is an enlarged longitudinal sectional view of a portion of FIG. 5, and FIGS. 6(*b*) to 6(*d*) are enlarged longitudinal sectional views of a portion of FIG. 6(*a*) in a manufacturing process.
Figure 6B:
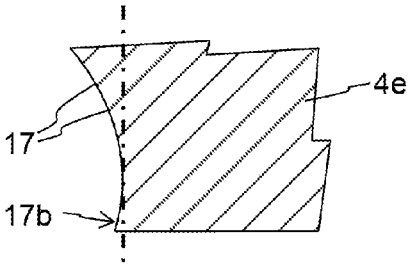
Figure 6C:
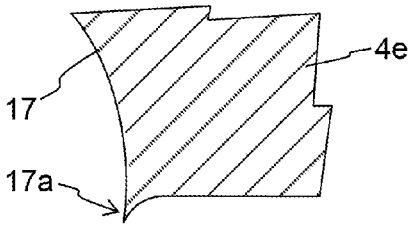
Figure 6D:
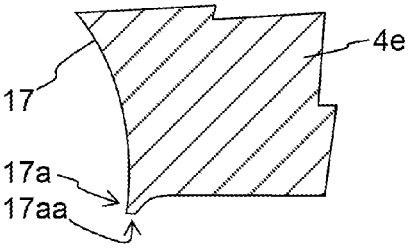

The liquid ejecting heads 2 according to the embodiment of the present invention will now be described. FIG. 2 is a plan view of a head body 2*a*, which is the main portion of each liquid ejecting head 2 illustrated in FIG. 1. FIG. 3 is an enlarged plan view of a portion of the head body 2*a* in the region enclosed by the dotted-chain line in FIG. 2. In FIG. 3, some channels are omitted to simplify the description. FIG. 4 is an enlarged plan view of the same portion as that in FIG. 3, where channels other than those omitted in FIG. 3 are omitted. FIG. 5 is a longitudinal sectional view taken along line V-V in FIG. 3. In FIGS. 3 and 4, compression chambers 10, restricting portions 6, ejection holes 8, etc., which are arranged below a piezoelectric actuator substrate 21 and therefore are to be drawn with broken lines, are drawn with solid lines to facilitate understanding of the drawing.

Each liquid ejecting head 2 may include a reservoir, which supplies the liquid to the head body 2*a*, and a housing in addition to the head body 2*a*. The head body 2*a* includes a channel member 4 and the piezoelectric actuator substrate 21 having displacement elements 30, which are compressing portions, formed therein.

The channel member 4 of the head body 2*a* includes manifolds 5 that serve as common channels, the compression chambers 10 connected to the manifolds 5, and the ejection holes 8 connected to the compression chambers 10. The compression chambers 10 open at the top surface of the channel member 4, and the top surface of the channel member 4 serves as a compression chamber surface 4-2. The top surface of the channel member 4 has holes 5*a* connected to the manifolds 5, and liquid is supplied to the manifolds 5 through the holes 5*a*.

The piezoelectric actuator substrate 21 including the displacement elements 30 is bonded to the top surface of the channel member 4 such that each displacement element 30 is arranged above the corresponding compression chamber 10. Signal transmission units 60 that supply signals to the displacement elements 30 are connected to the piezoelectric actuator substrate 21. In FIG. 2, to clearly illustrate the state in which two signal transmission units 60 are connected to the piezoelectric actuator substrate 21, the contours of the signal transmission units 60 in the regions around the portions that are connected to the piezoelectric actuator substrate 21 are shown by the dotted lines. Electrodes formed on the signal transmission units 60 and electrically connected to the piezoelectric actuator substrate 21 are arranged in a rectangular pattern at the ends of the signal transmission units 60. The two signal transmission units 60 are connected to the piezoelectric actuator substrate 21 such that the ends there of are in a central region of the piezoelectric actuator substrate 21 in the short-side direction.

The head body 2*a* includes the flat plate-shaped channel member 4 and a single piezoelectric actuator substrate 21 that is bonded to the channel member 4 and that includes the displacement elements 30. The piezoelectric actuator substrate 21 has a rectangular shape in plan view, and is arranged on the top surface of the channel member 4 such that the long sides of the rectangular shape extend in the long-side direction of the channel member 4.

Two manifolds 5 are formed in the channel member 4. The manifolds 5 have a long and narrow shape that extends from one end of the channel member 4 in the long-side direction toward the other end. Each manifold 5 has openings 5*a* that open at the top surface of the channel member 4 at both ends of the manifold 5.

Each manifold 5 is partitioned into sections by partition walls 15 at least in a central region thereof in the long-side direction, that is, a region in which the manifold 5 is connected to the compression chambers 10. The partition walls 15 are spaced from each other in the short-side direction. In the central region in the long-side direction, which is the region in which the manifold 5 is connected to the compression chambers 10, the partition walls 15 have the same height as that of the manifold 5 so that the manifold 5 is completely partitioned into a plurality of sub-manifolds 5*b*. Accordingly, the ejection holes 8 and cannels extending from the ejection holes 8 to the compression chambers 10 can be formed so as to overlap the partition walls 15 in plan view.

The sections into which each manifold 5 is partitioned may be referred to as the sub-manifolds 5*b*. In the present embodiment, two independent manifolds 5 are provided, and each manifold 5 has the openings 5*a* at both ends thereof. Each manifold 5 has seven partition walls 15 that partition the manifold 5 into eight sub-manifolds 5*b*. The width of the sub-manifolds 5*b* is greater than that of the partition walls 15, so that the sub-manifolds 5*b* allow a large amount of liquid to flow therethrough.

The compression chambers 10 are arranged two dimensionally in the channel member 4. The compression chambers 10 are hollow spaces having a diamond shape with rounded corners or an elliptical shape in plan view.

Each compression chamber 10 is connected to one of the sub-manifolds 5*b* through the corresponding restricting portion 6. Two compression chamber rows 11 are arranged one on each side of each sub-manifold 5*b* so as to extend along the sub-manifold 5*b*, each compression chamber row 11 including compression chambers 10 that are connected to the sub-manifold 5*b*. Accordingly, 16 compression chamber rows 11 are provided for each manifold 5, and 32 compression chamber rows 11 are provided in total in the head body 2*a*. In each compression chamber row 11, the compression chambers 10 are arranged with constant intervals therebetween in the long-side direction, the intervals corresponding to, for example, 37.5 dpi.

The compression chamber rows 11 have dummy compression chambers 16 at the ends thereof so that the dummy compression chambers 16 form a dummy compression chamber line. The dummy compression chambers 16 belonging to the dummy compression chamber line are connected to the manifolds 5, but are not connected to the ejection holes 8. Also, a dummy compression chamber row in which the dummy compression chambers 16 are linearly arranged is provided at each outer side of the 32 compression chamber rows 11. The dummy compression chambers 16 belonging to the dummy compression chamber rows are not connected to the manifolds 5 or the ejection holes 8. Owing to the dummy compression chambers 16, the second compression chambers 10 from the edges have surrounding structures (rigidities) similar to those of the surrounding structures (rigidities) of the other compression chambers 10, so that differences in the liquid ejecting characteristics can be reduced. The influence of the differences between the surrounding structures is large for the compression chambers 10 arranged next to each other in the longitudinal direction, which are close to each other. For this reason, the dummy compression chambers are provided at both ends in the longitudinal direction. Since the influence is relatively small in the width direction, the dummy compression chambers are provided only at the sides close to the edges of the head body 21*a*. Accordingly, the width of the head body 21*a* can be reduced.

The compression chambers 10 connected to each manifold 5 are arranged in a grid pattern having rows and columns along the outer sides of the rectangular piezoelectric actuator substrate 21. Accordingly, individual electrodes 25, which are arranged above the compression chambers 10, are evenly spaced from the outer sides of the piezoelectric actuator substrate 21. Therefore, the piezoelectric actuator substrate 21 is not easily deformed when the individual electrodes 25 are formed. If the piezoelectric actuator substrate 21 is largely deformed when the piezoelectric actuator substrate 21 and the channel member 4 are bonded together, there is a risk that the displacement elements 30 near the outer sides will receive a stress and the displacement characteristics thereof will vary. The variation in the displacement characteristics can be reduced by reducing the deformation. The influence of the deformation is further reduced since the dummy compression chamber rows including the dummy compression chambers 16 are provided on the outer side of the compression chamber rows 11 that are closest to the outer sides of the piezoelectric actuator substrate 21. The compression chambers 10 belonging to each compression chamber row 11 are arranged with constant intervals therebetween, and the individual electrodes 25 that correspond to the compression chamber rows 11 are also arranged with constant intervals therebetween. The compression chamber rows 11 are arranged with constant intervals therebetween in the short-side direction, and the rows of the individual electrodes 25 corresponding to the compression chamber rows 11 are also arranged with constant intervals therebetween in the short-side direction. Accordingly, regions in which the influence of crosstalk, in particular, is significant may be eliminated.

Although the compression chambers 10 are arranged in a grid pattern in the present embodiment, they may instead be arranged in a staggered pattern in which the compression chambers 10 of each compression chamber row 11 are disposed between the compression chambers 10 of the adjacent compression chamber row 11. In this case, the distance between the compression chambers 10 belonging to the adjacent compression chamber rows 11 can be increased, so that crosstalk can be further reduced.

Irrespective of how the compression chamber rows 11 are arranged, crosstalk can be reduced by arranging the compression chambers 10 such that, in plan view of the channel member 4, the compression chambers 10 of each compression chamber row 11 do not overlap the compression chambers 10 of the adjacent compression chamber row 11 in the long-side direction of the liquid ejecting head 2. If the distances between the compression chamber rows 11 are increased, the width of the liquid ejecting head 2 is increased accordingly. As a result, the accuracy of the angle at which the liquid ejecting head 2 is attached to the printer 1 greatly affects the printing result. When multiple liquid ejecting heads 2 are used, the accuracy of the relative positions between the liquid ejecting heads 2 also greatly affects the printing result. The influence of these accuracies on the printing result can be reduced by setting the width of the partition walls 15 smaller than that of the sub-manifolds 5*b*.

The compression chambers 10 connected to each sub-manifold 5*b* form two compression chamber rows 11, and the ejection holes 8 connected to the compression chambers 10 belonging to each compression chamber row 11 form a single ejection hole row 9. The ejection holes 8 connected to the compression chambers 10 belonging to the two compression chamber rows 11 open at different sides of the sub-manifold 5*b*. Although two ejection hole rows 9 are provided on each partition wall 15 in FIG. 4, the ejection holes 8 belonging to each ejection hole row 9 are connected to the sub-manifold 5*b* adjacent to the ejection holes 8 through the compression chambers 10. When the ejection holes 8 connected to the adjacent sub-manifolds 5*b* through the compression chamber rows 11 are arranged so as not to overlap in the long-side direction of the liquid ejecting head 2, crosstalk between the channels that connect the compression chambers 10 to the ejection holes 8 can be suppressed. Thus, crosstalk can be further reduced. When the entireties of the channels that connect the compression chambers 10 to the ejection holes 8 do not overlap in the long-side direction of the liquid ejecting head 2, crosstalk can be further reduced.

The compression chambers 10 connected to each manifold 5 form a compression chamber group. Since there are two manifolds 5, two compression chamber groups are provided. The compression chambers 10 that contribute to ejection in the compression chamber groups are arranged in the same way at positions translated from one another in the short-side direction. The compression chambers 10 are arranged along the top surface of the channel member 4 over almost the entirety of the region that faces the piezoelectric actuator substrate 21, although there are regions in which the intervals between the compression chambers 10 are somewhat large, such as the region between the compression chamber groups. In other words, the compression chamber groups including the compression chambers 10 occupy a region having substantially the same shape as that of the piezoelectric actuator substrate 21. The open side of each compression chamber 10 is covered with the piezoelectric actuator substrate 21 that is bonded to the top surface of the channel member 4.

Each compression chamber 10 has a channel extending therefrom at a corner that opposes the corner at which the restricting portion 6 is connected to the compression chamber 10, the channel extending to the corresponding ejection hole 8 which opens in an ejection-hole surface 4-1 at the bottom of the channel member 4. The channel extends in a direction away from the compression chamber 10 in plan view. More specifically, the channel extends away from the compression chamber 10 in the diagonal direction of the compression chamber 10 while being shifted leftward or rightward relative to the diagonal direction. Accordingly, although the compression chambers 10 are arranged in a grid pattern such that the intervals therebetween in each compression chamber row 11 correspond to 37.5 dpi, the ejection holes 8 may be arranged with intervals corresponding to 1200 dpi over the entire region.

In other words, if the ejection holes 8 are projected onto a plane orthogonal to an imaginary straight line that is parallel to the long-side direction of the channel member 4, the 16 ejection holes 8 connected to each of the manifolds 5 in the region R enclosed by the imaginary straight lines in FIG. 4, that is, 32 ejection holes 8 in total, are arranged at constant intervals that correspond to 1200 dpi. This means that, when ink of the same color is supplied to both of the manifolds 5, an image can be formed at a resolution of 1200 dpi in the long-side direction. The 1 ejection holes 8 connected to each manifold 5 are arranged at constant intervals corresponding to 600 dpi in the region R enclosed by the imaginary straight lines in FIG. 4. Accordingly, when inks of different colors are supplied to the manifolds 5, a two-color image can be formed at a resolution of 600 dpi in the long-side direction. When two liquid ejecting heads 2 are used, a four-color image can be formed at a resolution of 600 dpi. In this case, the printing accuracy is higher than that achieved when four liquid ejecting heads capable of performing printing at 600 dpi are used, and print settings can be facilitated. The ejection holes 8 connected to the compression chambers 10 belonging to a single compression chamber line that extends in the short-side direction of the head body 2*a* cover the region R enclosed by the imaginary straight lines.

The individual electrodes 25 are formed on the top surface of the piezoelectric actuator substrate 21 at positions where the individual electrodes 25 face the corresponding compression chambers 10. Each individual electrode 25 is somewhat smaller than the corresponding compression chamber 10, and includes an individual electrode body 25*a* having a shape that is substantially similar to that of the compression chamber 10 and a lead electrode 25*b* that extends from the individual electrode body 25*a*. Similar to the compression chambers 10, the individual electrodes 25 also form individual electrode rows and individual electrode groups. Common-electrode surface electrodes 28 are also formed on the top surface of the piezoelectric actuator substrate 21. The common-electrode surface electrodes 28 are electrically connected to a common electrode 24 by through conductors (not illustrated) formed in a piezoelectric ceramic layer 21*b*.

The ejection holes 8 are located outside the regions that face the manifolds 5 arranged at the bottom side of the channel member 4. Also, the ejection holes 8 are arranged in a region facing the piezoelectric actuator substrate 21 at the bottom side of the channel member 4. The ejection holes 8 occupy a region having substantially the same shape as that of the piezoelectric actuator substrate 21 as a single group.

Liquid droplets are ejected from the ejection holes 8 when the corresponding displacement elements 30 of the piezoelectric actuator substrate 21 are displaced.

The channel member 4 included in the head body 2*a* has a multilayer structure in which multiple plates are stacked together with adhesive layers 18 interposed therebetween. The plates include a cavity plate 4*a*, an aperture (restricting portion) plate 4*b*, a supply plate 4*c*, manifold plates 4*d* to 4*i*, a cover plate 4*j*, and a nozzle plate 4*k* in that order from the top of the channel member 4. Multiple holes are formed in these plates. Each plate has a thickness of about 10 to 300 μm, so that high-precision holes can be formed. The channel member 4 has a thickness of about 500 μm to 2 mm. The plates are positioned relative to each other and stacked together so that the holes formed therein communicate with each other so as to form independent channels 12 and the manifolds 5. The head body 2*a* is configured such that the compression chambers 10 are formed in the top surface of the channel member 4, the manifolds 5 are formed in the channel member 4 at the bottom side of the channel member 4, and the ejection holes 8 are formed in the bottom surface of the channel member 4. Portions that form the independent channels 12 are arranged near each other at different locations so that the manifolds 5 are connected to the ejection holes 8 through the compression chambers 10.

The holes and grooves formed in each plate will now be described. The holes and grooves include holes and grooves that constitute liquid channels, and also include adhesive receiving grooves 17 formed around the holes and grooves that constitute the channels. The receiving grooves 17 will be described below.

The holes and grooves that constitute the channels include the following first to fourth communication holes. The first communication holes are the compression chambers 10 formed in the cavity plate 4*a*. The second communication holes are those that constitute the restricting portions 6, each of which connects one end of the corresponding compression chamber 10 to the corresponding manifold 5. These communication holes are formed in each of the aperture plate 4*b* (specifically, the inlets of the compression chambers 10) and the supply plate 4*c* (specifically, the outlets of the manifolds 5).

The third communication holes are descenders 7, which are portions of the channels that extend from the ends of the compression chambers 10 opposite the ends connected to the restricting portions 6 to the ejection holes 8. The descenders 7 are formed in each of the plates from the base plate 4*b* (specifically, the outlets of the compression chambers 10) to the nozzle plate 4*k* (specifically, the ejection holes 8).

The fourth communication holes are those that constitute the sub-manifolds 5*a*. These communication holes are formed in the manifold plates 4*c* to 4*i*. The holes are formed in the manifold plates 4*c* to 4*i* so that partitioning portions that form the partition walls 15 remain so as to define the sub-manifolds 5*b*. The partitioning portions of the manifold plates 4*c* to 4*i* are connected to the manifold plates 4*c* to 4*i* by half-etched support portions (not illustrated).

The first to fourth communication holes are connected to each other to form the independent channels 12 extending from the inlets through which the liquid is supplied form the manifolds 5 (outlets of the manifolds 5) to the ejection holes 8. The liquid supplied to the manifolds 5 is ejected from each ejection hole 8 along the following path. First, the liquid flows upward from the corresponding manifold 5 to one end of the corresponding restricting portion 6. Next, the liquid flows horizontally in the extending direction of the restricting portion 6 to the other end of the restricting portion 6. Then, the liquid flows upward toward one end of the corresponding compression chamber 10. Then, the liquid flows horizontally in the extending direction of the compression chamber 10 to the other end of the compression chamber 10. The liquid enters the corresponding descender 7 from the compression chamber 10 and flows mainly downward while moving also in the horizontal direction. Then, the liquid reaches the ejection hole 8 that opens in the bottom surface, and is ejected outward.

The piezoelectric actuator substrate 21 has a multilayer structure including two piezoelectric ceramic layers 21*a* and 21*b* composed of piezoelectric materials. Each of the piezoelectric ceramic layers 21*a* and 21*b* has a thickness of about 20 μm. The thickness of the piezoelectric actuator substrate 21 from the bottom surface of the piezoelectric ceramic layer 21*a* to the top surface of the piezoelectric ceramic layer 21*b* is about 40 μm. Each of the piezoelectric ceramic layers 21*a* and 21*b* extends over the compression chambers 10. The piezoelectric ceramic layers 21*a* and 21*b* are made of a ferroelectric ceramic material, such as a lead zirconate titanate (PZT) based, $NaNbO_3$ based, $BaTiO_3$ based, (BiNa)$NbO_3$ based, or $BiNaNb_5O_{15}$ based ceramic material. The piezoelectric ceramic layer 21*a* serves as a vibration substrate, and is not necessarily composed of a piezoelectric material. The piezoelectric ceramic layer 21*a* may be replaced by, for example, a ceramic layer that is not composed of a piezoelectric material or a metal plate.

The piezoelectric actuator substrate 21 includes the common electrode 24 made of a metal material such as a Ag—Pd-based material, and the individual electrodes 25 made of a metallic material such as a Au-based material. The common electrode 24 has a thickness of about 2 μm, and the individual electrodes 25 have a thickness of about 1 μm.

The individual electrodes 25 are formed on the top surface of the piezoelectric actuator substrate 21 at positions where the individual electrodes 25 face their respective compression chambers 10. Each individual electrode 25 is somewhat smaller than a compression chamber body 10*a* in plan view, and includes an individual electrode body 25*a* having a shape that is substantially similar to that of the compression chamber body 10*a* and a lead electrode 25*b* that extends from the individual electrode body 25*a*. A connecting electrode 26 is provided on an end portion of the lead electrode 25*b* that extends away from the region facing the compression chamber 10. The connecting electrode 26 is formed of a conductive resin containing conductive powder, such as silver powder, and has a thickness of about 5 to 200 μm. The connecting electrode 26 is electrically bonded to a corresponding one of the electrodes provided on the signal transmission units 60.

Drive signals are supplied to the individual electrodes 25 from the control unit 88 through the signal transmission units 60. This will be described in detail below. The drive signals are supplied at a constant period in synchronization with the conveyance speed of the print medium P.

The common electrode 24 is arranged between the piezoelectric ceramic layer 21*b* and the piezoelectric ceramic layer 21*a* so as to extend over almost the entire surfaces thereof in the planar direction. In other words, the common electrode 24 extends so as to cover all of the compression chambers 10 within the region that faces the piezoelectric actuator substrate 21. The common electrode 24 is connected to the common-electrode surface electrodes 28 by the through conductors that extend through the piezoelectric ceramic layer 21*b*. The common-electrode surface electrodes 28 are formed on the piezoelectric ceramic layer 21*b* at locations separated from the electrode groups of the individual electrodes 44. The common electrode 24 is grounded by the common-electrode surface electrodes 28, and is maintained at the ground potential. Similar to the individual electrodes 25, the common-electrode surface electrodes 28 are directly or indirectly connected to the control unit 88.

Portions of the piezoelectric ceramic layer 21*b* that are interposed between the individual electrodes 25 and the common electrode 24 are polarized in the thickness direction, and serve as displacement elements 30 having a unimorph structure that are displaced when a voltage is applied to the individual electrodes 25. More specifically, when the individual electrodes 25 and the common electrode 24 are set to different potentials to apply an electric field to the piezoelectric ceramic layer 21*b* in the direction of polarization thereof, the portions to which the electric field is applied function as active portions that are deformed due to the piezoelectric effect. When the control unit 88 sets the individual electrodes 25 to a predetermined positive or negative potential relative to the potential of the common electrode 24 so that the direction of the electric field is the same as the direction of polarization, the portions of the piezoelectric ceramic layer 21*b* interposed between the electrodes (active portions) contract in the planar direction. Conversely, the piezoelectric ceramic layer 21*a*, which is an inactive layer, is not affected by the electric field, and therefore does not contract by itself but tries to restrict the deformation of the active portions. As a result, the piezoelectric ceramic layer 21*a* and the piezoelectric ceramic layer 21*b* are deformed by different amounts in the direction of polarization, so that the piezoelectric ceramic layer 21*a* is deformed so as to be convex toward the compression chambers 10 (unimorph deformation).

The liquid ejection operation will now be described. The displacement elements 30 are driven (displaced) in response to drive signals supplied to the individual electrodes 25 through, for example, a driver IC under the control of the control unit 88. Although the liquid ejection operation can be performed by using various types of drive signals in the present embodiment, a so-called pulling driving method will be described here.

The individual electrodes 25 are initially set to a potential higher than that of the common electrode 24 (hereafter referred to as a high potential). The potential of each individual electrode 25 is temporarily reduced to that of the common electrode 24 (hereafter referred to as a low potential) every time an ejection request is issued, and is then returned to the high potential at a predetermined timing. Accordingly, the piezoelectric ceramic layers 21*a* and 21*b* return (start to return) to their original (flat) shape at the time when the individual electrode 25 is set to the low potential, and the volume of the corresponding compression chamber 10 increases from that in the initial state (state in which the independent and common electrodes are set to different potentials). Therefore, a negative pressure is applied to the liquid in the compression chamber 10. As a result, the liquid in the compression chamber 10 starts to vibrate at its natural vibration period. More specifically, first, the volume of the compression chamber 10 start to increase, and the negative pressure gradually decreases. Then, the volume of the compression chamber 10 reaches a maximum volume, and the pressure decreases to approximately zero. Then, the volume of the compression chamber 10 starts to decrease, and the pressure starts to increase. The individual electrode 25 is set to the high potential substantially when the pressure reaches a maximum pressure. Accordingly, the vibration applied first and the vibration applied next are combined so that a larger pressure is applied to the liquid. The pressure is transmitted through the corresponding descender 7, so that the liquid is ejected from the corresponding ejection hole 8.

Thus, a liquid droplet can be ejected by applying a pulse driving signal to the individual electrode 25, the driving signal being set basically to the high potential and to the low potential for a predetermined period. In principle, the liquid ejection speed and the amount of ejection can be maximized by setting the pulse width to an acoustic length (AL), which is half the natural vibration period of the liquid in the compression chamber 10. The natural vibration period of the liquid in the compression chamber 10 depends greatly on the properties of the liquid and the shape of the compression chamber 10, but it depends also on the properties of the piezoelectric actuator substrate 21 and the properties of the channels connected to the compression chamber 10.

The pulse width is set to a value that is about 0.5AL to 1.5AL in practice because of other factors to be taken into consideration, for example, to eject the liquid in the form of a single droplet. Since the amount of ejection can be reduced by setting the pulse width to a value different from AL, the pulse width may be set to a value different from AL for the purpose of reducing the amount of ejection.

When the plates 4*a* to 4*k* are bonded together with the adhesive layers 18 interposed therebetween, unbonded portions will remain unless a sufficient amount of adhesive is applied so that the adhesive is spread over the entire surfaces between the plates 4*a* to 4*k*. When a pressure is applied to bond the plates 4*a* to 4*k* together while the adhesive is spread over the entire surfaces between the plates 4*a* to 4*k*, some of the adhesive flows into the channels.

Accordingly, the adhesive receiving grooves 17 are arranged around the holes and grooves that constitute the channels. The receiving grooves 17 are basically grooves in the plates 4*a* to 4*j*, and are formed by, for example, half-etching the plates 4*a* to 4*j*. The receiving grooves 17 may instead be formed so as to extend through the plates 4*a* to 4*j*, and such structures are also referred to as the receiving grooves 17.

FIGS. 6(*a*) to 6(*d*) will now be described. FIG. 6(*a*) is an enlarged longitudinal sectional view of a portion of FIG. 5. FIGS. 6(*b*) to 6(*d*) are enlarged longitudinal sectional views of the same portion of FIG. 6(*a*) in different steps.

The holes and grooves that constitute the sub-manifolds 5*a* and the independent channels 12, which are the liquid channels, are formed by etching the plates 4*a* to 4*j*. FIG. 5 does not illustrate the detailed shapes formed by the etching process. In FIG. 5, the adhesive layers 18 are also omitted. The holes that extend through the plates 4*a* to 4*j* are formed by etching the plates 4*a* to 4*j* from both sides. The dimensions of these holes at the centers of the plates 4*a* to 4*j* in the thickness direction are smaller than the dimensions of the openings of the holes. Grooves having a depth that is approximately half the thickness of the plates 4*a* to 4*j* are formed by half-etching the plates 4*a* to 4*j* from one side thereof. The dimensions of these grooves around the bottom thereof are smaller than the dimensions of the openings of the grooves.

The though holes that are formed in the plate 4*k* and that have the ejection holes 8 at one open side thereof are formed by punching.

FIG. 6(*a*) is an enlarged longitudinal sectional view illustrating the state in which the plate 4*e*, in which the receiving groove 17 is formed, and the plate 4*f* are stacked together with the adhesive layer 18 interposed therebetween. The adhesive layer 18 is formed by curing an adhesive applied to a principal surface of the plate 4*e* by a transferring process. Since the adhesive is applied by the transferring process, the adhesive is not applied to the inner region of the receiving groove 17. Although there may be a case where the receiving groove 17 has received the adhesive in a bonding-stacking process, the receiving groove 17 free from the adhesive is illustrated here. A first projection 17*a*, which projects from the principal surface of the plate 4*e* in which the receiving groove 17 is formed, is provided at an edge of the receiving groove 17.

The receiving groove 17 is disposed around a hole or groove that constitutes a channel. Basically, the receiving groove 17 is formed in an annular shape so as to surround the hole or groove that constitutes the channel. When the receiving groove 17 is provided, some of the adhesive flows into the receiving groove 17 in the stacking process. Therefore, the amount of adhesive that flows into the channel can be reduced, and the risk of clogging of the channel and a variation in the characteristics of the channel can be reduced. Although the adhesive flows toward the channel from the entire periphery of the channel, when the receiving groove 17 is arranged so as to surround the channel, the amount of adhesive that flows into the channel can be further reduced.

The reduction in the amount of adhesive that flows into the channel is achieved by the receiving groove 17 based on the following two factors. The first factor is that the adhesive is prevented from flowing beyond the receiving groove 17. The amount of adhesive supplied to the receiving groove 17 is generally not so large as to make the receiving groove 17 filled with the adhesive. Therefore, the adhesive that has flowed into the receiving groove 17 hardly flows out of the receiving groove 17 and into the channel. When the receiving groove 17 is arranged so as to continuously surround the channel, the risk that the adhesive will flow into the channel from the region outside the receiving groove 17 can be substantially eliminated. Therefore, the adhesive that may flow into the channel is only the adhesive supplied to the adhesion area surrounded by the receiving groove 17.

The second factor is that the adhesive in the adhesion area between the receiving groove 17 and the channel flows into one of the receiving groove 17 and the channel that is closer thereto. Owing to this function, the amount of adhesive that flows into the channel can be reduced even when the receiving groove 17 is not formed so as to continuously surround the channel.

The amount of adhesive that flows into the channel is affected by the amount of adhesive that is applied and by the temperature and pressure in the stacking process. Although these parameters can be controlled by step management, there may be variations. When a thermosetting adhesive is used, a pressure is applied at a high temperature in the bonding-stacking process, and therefore the viscosity of the adhesive is reduced. When a designed amount of adhesive or more adhesive is applied, and when the viscosity of the adhesive in the bonding-stacking process is further reduced due to variations in the composition and properties of the adhesive or a variation in the temperature in the bonding-stacking process, the thickness of the adhesive layer 18 may be reduced. In such a case, the amount of adhesive that flows into the channel may increase.

Accordingly, the first projection 17*a* is provided at the edge of the receiving groove 17 so as to project from the principal surface of the corresponding one of the plates 4*a* to 4*j*, so that the thickness of the adhesive layer 18 is not easily reduced. The height of the first projection 17*a* from the principal surface of the corresponding one of the plates 4*a* to 4*j* is greater than the average thickness of the adhesive layer 18. The first projection 17*a* is in contact with one of the plates 4*a* to 4*k* that is stacked on the one of the plates 4*a* to 4*j* on which the first projection 17*a* is provided. It is not necessary that the first projection 17*a* be formed continuously along the edge of the receiving groove 17, and may be provided on a portion of the edge of the receiving groove 17. In addition, it is not necessary that the first projection 17*a* have a constant height as long as the height of the highest portion of the first projection 17*a* is greater than the average height of the adhesive layer 18 and as long as the highest portion of the first projection 17*a* is in contact with the one of the plates 4*a* to 4*k* that is stacked on the plate on which the first projection 17*a* is formed.

The average thickness of the adhesive layer 18 is, for example, 0.1 μm or more and 2.5 μm or less. The height of the first projection 17*a* is, for example, 0.5 μm or more and 3 μm or less. When the height of the first projection 17*a* is greater than the average thickness of the adhesive layers 18, a portion of the first projection 17*a* comes into contact with the one of the plates 4*a* to 4*k* that is stacked on the plate on which the first projection 17*a* is formed. The height of the first projection 17*a* is the height of the first projection 17*a* in the state in which the one of the plates 4*a* to 4*k* that is stacked on the first projection 17*a* is removed, and can be measured on the cross section of the one of the plates 4*a* to 4*j* on which the first projection 17*a* is formed after removing the plate stacked thereon. The average thickness of the adhesive layer 18 is the average thickness of the adhesive layer 18 for which the first projection 17*a* is formed, and can be determined by measuring the thickness of the adhesive layer 18 at four to six arbitrary positions on the cross section of the channel member 4 and calculating the average. Since the thickness of the adhesive layer 18 may vary depending on the structure of the surrounding holes and grooves, half of the measurement points are preferably at locations where the holes and grooves are densely formed, and the other half are preferably at locations where not so many holes and grooves are formed. Since the edges of the holes and grooves may be locally deformed, as in the region where the first projection 17*a* is formed, the measurement is preferably performed at locations where such deformation has not occurred.

In the state in which the plates 4*a* to 4*j* are stacked together, the first projection 17*a* is disposed between the layers of the plates 4*a* to 4*k* because the thickness of the adhesive layer 18 in the region surrounding the first projection 17*a* is greater than the average thickness of the adhesive layer 18, because the end of the first projection 17*a* bites into the one of the plates 4*a* to 4*k* that is stacked thereon, or because the edge of the receiving groove 17 on which the first projection 17*a* is formed is locally deformed so as to tilt toward the center of the receiving groove 17.

In the bonding-stacking process, the first projection 17*a* prevents the adhesive layer 18 from being excessively thin by coming into contact with one of the plates 4*a* to 4*k* that is stacked thereon, thereby reducing the amount of adhesive that flows into the channel. When the amount of adhesive supplied in the manufacturing process is excessively small, the end of the first projection 17*a* is squashed or the edge of the receiving groove 17 is deformed so that the distance between the plates 4*a* to 4*k* that are stacked together is reduced. Therefore, the risk of adhesion failure due to lack of adhesive can be reduced. When the first projection 17*a* is excessively high, there is a risk that adhesion failure will occur when the amount of adhesive is small. Therefore, the height of the first projection 17*a* is preferably 3 μm or less.

The hole or groove that constitutes a channel may also have a second projection at an edge thereof, the second projection projecting from the principal surface of the corresponding one of the plates 4*a* to 4*j*. The second projection has an effect similar to that of the first projection 17*a*, and is capable of reducing the amount of adhesive that flows into the channel. In a channel such as the descender 7 that is formed of holes that are connected together so as to be slightly shifted from each other, the second projection is exposed in the channel at locations where the holes are shifted from each other. Even when the holes are not designed so as to be shifted from each other as in the descender 7, the second projection may be exposed in the channel due to a displacement caused in the stacking process. When the second projection is exposed in the channel, there is a risk that the liquid flow will be disturbed by the projecting portion. Therefore, the second projection is not formed at the edge of the hole or groove that constitutes a channel, or is formed so as to be shorter than the first projection 17*a*. Whether or not the second projection is present and whether or not the second projection is shorter than the first projection 17*a* can be confirmed on the longitudinal cross section of the channel member 4 including the first projection 17*a*. When the second projection is not present or when the second projection that is shorter than the first projection 17*a* is present on the longitudinal cross section, the channel on the cross section has the above-described effect.

When second projections having different heights are provided, the adhesive that flows into the channel may be concentrated at the location where a short second projection is provided. Depending on the manner in which the adhesive flows into the channel, the adhesive that has flowed into the channel may form a lump that projects into the channel. In such a case, the influence on the liquid flow may be greater than that in the case where the adhesive flows into the channel over the entire circumference of the channel and the size of the channel is slightly reduced. To reduce such a risk, the second projection is not provided or is formed so as to be shorter than the first projection.

A groove that constitutes a channel may be used to accurately form a channel having a high channel resistance. The second projection on such a groove, in particular, is preferably shorter than the first projection 17*a* of the receiving groove 17 arranged around the groove. More preferably, the second projection is not provided on such a groove. Whether or not the second projection is present and whether or not the second projection is shorter than the first projection 17*a* can be confirmed on the longitudinal cross section of the channel member 4 including the first projection 17*a*.

An example of a groove that constitutes a channel is a restricting portion body 6*a* of each restricting portion 6 that extends in a planar direction of the plate 4*b*. In the ejection process using the pulling method, each restricting portion 6 serves to reflect the pressure applied to the corresponding compression chamber 10 and increase the ejection pressure. Therefore, the restricting portion 6 is required to have a high, accurate channel resistance. Also when another ejection method is used, the restricting portion 6 affects whether the pressure applied to the compression chamber 10 is transmitted to the ejection hole 8 or released to the sub-manifold 5*a*. Therefore, the channel resistance is required to be relatively high and accurate.

The restricting portion 6 includes the restricting portion body 6*a* that extends in the planar direction of the plate 4*b*, and an inlet 6*b* and outlet 6*c* that extend in a stacking direction in which the plates 4*a* to 4*k* are stacked. The channel resistance of the restricting portion 6 is greatly affected by the restricting portion body 6*a*, which has a high channel resistance. The restricting portion body 6*a* is formed by half-etching as a groove that does not extend through the plate 4*b*. Therefore, the restricting portion body 6*a* has a small height, that is, depth. When the second projection is provided at an edge of the restricting portion body 6*a*, a variation in the height thereof causes a variation in the cross-sectional area of the channel, which greatly affects the ejection characteristics. Therefore, preferably, the second projection is not formed at an edge of the restricting portion body 6*a*, or is formed so as to be shorter than the first projection 17*a*. Since the influence of the adhesive that flows into the restricting portion body 6*a* is relatively large, the receiving groove 17 is preferably arranged around the groove that constitutes the restricting portion body 6*a*. In the longitudinal cross section including the first projection 17*a* provided at the edge of the receiving groove 17, the amount of adhesive that flows into the groove that constitutes the channel that is adjacent to the first projection 17*a* can be reduced since the first projection 17*a* is present.

A method for manufacturing the channel member 4 will now be described. The channel member 4 is manufactured by a first step of preparing the plates 4*a* to 4*k* having the holes and grooves that constitute the channels, and a second step of applying the adhesive that forms the adhesive layers 18 between the plates 4*a* to 4*k* and bonding the plates 4*a* to 4*k* together. At least one of the plates 4*a* to 4*k* prepared in the first step has the adhesive receiving grooves 17, and the first projections 17*a* are provided at the edges of the receiving grooves 17 so as to project from the principal surface of the plate in which the receiving grooves 17 are formed.

The second step, which is the bonding-stacking step, is performed as follows. That is, the plate 4*k* is placed on a predetermined jig. Then, a thermosetting adhesive is applied to a side of the plate 4*j* that is adjacent to the ejection-hole surface 4-1 by, for example, a transferring process. The plate 4*j* to which the adhesive has been applied is positioned and stacked on the plate 4*k*. Then, the plates from the plate 4*i* to the plate 4*a* are successively stacked after the adhesive is applied thereto, so that a multilayer body is obtained. The multilayer body is pressed in the stacking direction and heated so that the adhesive is cured and the adhesive layers 18 are formed. Thus, the channel member 4 in which the plates 4*a* to 4*k* are stacked together is manufactured.

When the multilayer body is formed, the piezoelectric actuator substrate 21 may be stacked on the plate 4*a* after the adhesive is applied thereto. The piezoelectric actuator substrate 21 is also subjected to the heating-and-pressing process. Thus, the head body 2*a* is manufactured. When the receiving grooves 17 having the first projections 17*a* are provided on a side of the plate 4*a* that is adjacent to the piezoelectric actuator substrate 21, the above-described effect can be obtained when the plate 4*a* and the piezoelectric actuator substrate 21 are bonded together. More specifically, the amount of adhesive that flows into, for example, the compression chambers in the plate 4*a* can be reduced.

The receiving grooves 17 having the first projections 17*a* prepared in the first step are formed as follows. That is, plates made of a metal, such as a stainless steel, are prepared as the plates 4*a* to 4*j*. A resist is applied to the plates 4*a* to 4*j* such that portions to be dissolved in order to etch holes and grooves that constitute the channels and the receiving grooves 17 are exposed. Next, the plates 4*a* to 4*j* are immersed in etching liquid, so that the plates 4*a* to 4*j* are partially dissolved. Thus, the holes and grooves that constitute the channels and the receiving grooves 17 are formed.

Through holes are formed in the plate 4*k* by punching, each through hole serving as the ejection hole 8 at one open side thereof.

The holes and grooves are formed in the plates 4*a* to 4*j* from the principal surfaces of the plates 4*a* to 4*j*. Therefore, the dimensions of the holes and grooves are basically greater at the principal surfaces than at the inner regions. To increase the accuracy of the holes and grooves that are formed, etching is performed to a depth that is about half the thickness of the plates 4*a* to 4*j*. The holes are formed by performing etching evenly from both sides so that the etched portions are connected in a region around the center.

The receiving grooves 17 preferably have a small width because, as the width decreases, the adhesion area increases, the risk of leakage of the liquid from the channels decreases, and the bonding strength increases. When narrow receiving grooves 17 are formed under the above-described conditions, the receiving grooves 17 have a semicircular shape in cross section in the thickness direction of the plates 4*a* to 4*j*.

When, for example, the etching conditions are stronger than normal etching conditions, portions of the plates 4*a* to 4*j* that are covered with the resist can also be etched. The receiving groove 17 formed in this way has an overhanging portion 17*b* at an edge thereof, as illustrated in FIG. 6(*b*), so that an opening portion thereof is narrower than an inner portion thereof. The overhanging portion 17*b* preferably projects toward the inner region of the receiving groove 17 by about 20 μm or less. More preferably, the amount of projection is 2 μm or more and 15 μm or less, and still more preferably, 5 μm or more and 10 μm or less. The inner wall surface of the overhanging portion 17*b* is preferably inclined toward the inner region of the receiving groove 17 at an angle of 1 degree or more and 10 degrees or less, and more preferably, 2 degrees or more and 7 degrees or less.

To form the above-described shape, the thickness of the plates 4*a* to 4*j* is preferably 50 μm or more and 150 μm or less. Also, the depth of the receiving groove 17 is preferably 40% or more and 60% or less of the thickness of the plates 4*a* to 4*j*.

Subsequently, the plates 4*a* to 4*j* from which the resist has been removed are immersed in water or alcohol, such as isopropanol, and ultrasonic waves are applied to the plates 4*a* to 4*j*. The ultrasonic waves are applied, for example, for 10 minutes at a frequency of 42 kHz and an output of 600 W. Cavitation occurs when the ultrasonic waves are applied. Cavitation is a phenomenon in which liquid is locally decompressed in an inner region thereof so that bubbles are formed by gas of a component other than the liquid that has been dissolved in the liquid or gas of the liquid generated as a result of the pressure of the liquid becoming less than or equal to the saturated vapor pressure. When the cavitation occurs in the receiving groove 17, in particular, in a region around the edge, a portion of the edge of the overhanging portion 17*b* may be deformed so as to expand outward from the receiving groove 17. Thus, the first projection 17*a* may be formed, as illustrated in FIG. 6(*c*). Although the pressure increases in the region where the cavitation occurs, the pressure increase occurs in a local region because the generated bubbles dissolve into the liquid again or are liquefied.

Since the overhanging portion 17*b* is formed in advance, the first projection 17*a* is formed when the ultrasonic waves are applied under appropriate conditions. The height of the first projection 17*a* may be set to 0.5 μm or more. When the overhanging portion 17*b* is not formed, substantially no first projection 17*a* is formed even when the above-described ultrasonic waves are applied. It is determined that substantially no first projection 17*a* is formed when the height of the first projection 17*a* is not 0.1 μm or more. Even when the overhanging portion 17*b* is formed, substantially no first projection 17*a* is formed when the size of the overhanging portion is small or when the ultrasonic waves are weak. When the overhanging portion 17*b* is formed so that a first projection 17*a* having a height of 0.5 μm or more will be formed, a portion that overhangs remains at the edge of the receiving groove 17 after the ultrasonic waves are applied. Therefore, the overhanging portion 17*b* is preferably formed by etching such that the overhanging portion 17*b* is present after the channel member 4 is formed by the bonding-stacking process.

When the width of the receiving groove 17 is small, the cavitation pressure does not easily spread in the receiving groove 17 but easily concentrates at the edge of the receiving groove 17. Therefore, the width of the receiving groove 17 is preferably 300 μm or less, more preferably, 200 μm or less, and still more preferably, 100 μm or less.

When the cavitation occurs in a region outside the edge of the receiving groove 17, there is a possibility that the edge will be pushed toward the inner region of the receiving groove 17. However, when the cavitation occurs in a region outside the edge, the pressure does not easily concentrate at the edge because the pressure spreads outward, and therefore the inward deformation does not easily occur. Even when a portion of the edge is deformed inward, there is also a portion that is deformed outward, and the outwardly deformed portion forms the first projection 17*a*. Thus, the first projection 17*a* is somewhat randomly formed, and the edge of the receiving groove 17 also includes portions having short projections and portions free from projections. It is preferable that such portions are provided because they enable excess adhesive to easily flow therethrough into the receiving groove 17 in the bonding-stacking process. The holes and grooves that constitute the channels and the receiving groove 17 can also be formed by, for example, punching so that the edges can be deformed so as to project when punching is performed. However, in such a case, the projections have a relatively uniform height. Therefore, the first projection 17*a* is preferably formed by etching.

Among a hole and a groove, a groove more easily allows the pressure to concentrate at the edge thereof and thereby enables a higher projection to be formed at the edge thereof, because a groove has a bottom and the pressure does not easily spread in the direction toward the bottom. Therefore, the first projection 17*a* at the edge of the groove that serves as the receiving groove 17 can be formed so as to be higher than the second projection at an edge of a hole that constitutes a channel. Furthermore, as the volume or cross-sectional area of the groove decreases, the pressure more easily concentrates at the edge of the groove, and therefore the height of the projection at the edge more easily increases. Accordingly, by setting the cross-sectional area of the receiving groove 17 smaller than the cross-sectional area of a groove that constitutes a channel, the first projection 17*a* at the edge of the receiving groove 17 can be formed so as to be higher than the projection at the edge of the groove that constitutes the channel. The receiving groove 17 may be formed under etching conditions that differ from those for forming the holes and grooves that constitute the channels so that the receiving groove 17 has an overhanging edge and the holes and grooves that constitute the channels do not have an overhanging edge.

FIG. 6(*d*) is an enlarged longitudinal sectional view of the plate 4*e* illustrated in FIG. 6(*a*) after the bonding-stacking process. The end of the first projection 17*a* comes into contact with the plate 4*f* in the bonding-stacking process, and is then pressed so that the end of the first projection 17*a* is squashed and a head portion 17*aa* is formed. The head portion 17*aa* does not have a pointed end, but has a substantially flat end. It can be confirmed that the head portion 17*aa* has such a shape by separating the plate 4*e* from the plate 4*f* and observing the cross section. It can be determined whether or not the first projection 17*a* had been in contact with the plate 4*f* by checking whether or not the head portion 17*aa* is formed.

REFERENCE SIGNS LIST

1 color inkjet printer
2 liquid ejecting head
2*a* head body
4 channel member
4*a* to 4*k* plates (of channel member)
4-1 ejection-hole surface
4-2 compression chamber surface
5 manifold
5*a* opening (of manifold)
5*b* sub-manifold (common channel)
6 restricting portion
6*a* restricting portion body
6*b* inlet
6*c* outlet
7 descender (portion of channel)
8 ejection hole
9 ejection hole row
10 compression chamber
11 compression chamber row
12 independent channel
15 partition
16 dummy compression chamber
17 receiving groove
17*a* first projection (at edge of receiving groove)
17*aa* head portion (of first projection)
17*b* overhanging portion (at edge of receiving groove)
18 adhesive layer
21 piezoelectric actuator substrate
21*a* piezoelectric ceramic layer (vibration substrate)
21*b* piezoelectric ceramic layer
24 common electrode
25 individual electrode
25*a* individual electrode body
25*b* lead electrode
26 connecting electrode
28 common-electrode surface electrodes
30 displacement element
60 signal transmission unit
70 head mounting frame
72 head group
80A feed roller
80B take-up roller
82A guide roller
82B conveying roller
88 control unit
P print sheet

The invention claimed is:

1. A channel member with a channel comprising:

a plurality of plates; and an adhesive layer that is interposed between each pair of adjacent plates of the plurality of plates, wherein each plate of the plurality of plates includes a principal surface and has at least one of a hole and a first groove that constitutes the channel and is disposed in the principal surface, wherein at least one of the plurality of plates has a second groove that is disposed from the at least one of the hole and the first groove by an interval, wherein an edge of the second groove includes a first projection that projects toward a corresponding adjacent plate from the principal surface of the at least one of the plurality of plates having the second groove and the edge of the second groove, on which the projection is formed, is locally deformed, and wherein the second groove does not extend through the at least one of the plates that includes the second groove.

2. The channel member according to claim 1, wherein the first projection is in contact with another one of the plates that is stacked on the principal surface.

3. The channel member according to claim 1, wherein a height of the first projection is 0.5 μm or more and 3 μm or less.

4. The channel member according to claim 1, wherein a height of the first projection is greater than an average thickness of the adhesive layer.

5. The channel member according to claim 1, wherein, in a cross section including the first projection, an edge of the at least one of the hole and the first groove that is disposed in the principal surface and that constitutes the channel does not include a second projection that projects from the principal surface or includes the second projection whose height from the principal surface is smaller than a height of the first projection from the principal surface.

6. The channel member according to claim 5, wherein, in the cross section including the first projection, the edge of the at least one of the hole and the first groove that is disposed in the principal surface at a location adjacent to the first projection and that constitutes the channel does not include the second projection or includes the second projection whose height from the principal surface is smaller than the height of the first projection from the principal surface.

7. The channel member according to claim 1, wherein an average thickness of the adhesive layer is 0.1 f.tm or more and 2.5 f.tm or less.

8. The channel member according to claim 1, wherein the second groove has an overhanging shape in which an opening portion is narrower than an inner portion.

9. The channel member according to claim 1, wherein the second groove has a semicircular cross section.

10. The channel member according to claim 1, wherein the second groove does not constitute the channel.

11. The channel member according to claim 1, wherein the second groove of the at least one plate surrounds a corresponding hole or corresponding first groove of the at least one plate.

12. A liquid ejecting head comprising:

a channel member with a channel comprising a plurality of plates and an adhesive layer that is interposed between each pair of adjacent plates of the plurality of plates; and a plurality of compressing portions, wherein the channel member includes a plurality of ejection holes that are connected to the channel, and the plurality of compressing portions cause a liquid to be ejected from each hole of the plurality of ejection holes by compressing the liquid in the channel, each plate of the plurality of plates includes a principal surface and has at least one of a hole and a first groove that constitutes the channel and is disposed in the principal surface, at least one of the plurality of plates has a second groove that is disposed from the hole or the first groove by an interval, and an edge of the second groove includes a first projection that projects toward a corresponding adjacent plate from the principal surface of the at least one of the plurality of plates having the second groove and the edge of the second groove, on which the projection is formed, is locally deformed.

13. A recording device comprising:

the liquid ejecting head according to claim 12;

a conveying unit that conveys a recording medium to the liquid ejecting head; and a control unit that controls the liquid ejecting head.

14. The liquid ejecting head according to claim 12, wherein the channel member comprises a plurality of compressing chambers connected with the plurality of the ejection holes, wherein the plurality of compressing chambers include sixteen compressing chamber rows.

15. The liquid ejecting head according to claim 14, wherein a length of each compressing chamber of the plurality of compressing chambers in a first direction constituting the sixteen compressing chamber rows is smaller than a length of each compressing chamber of the plurality of compressing chambers in a second direction perpendicular to the first direction.

16. A liquid ejecting head comprising:

a channel member comprising:

a first plate with a first channel hole;

a second plate with a second channel hole that is at least partially aligned with the first channel hole; and an adhesive layer that is interposed between the first plate and the second plate and that adheres the first plate and the second plate; and a compressing portion that causes an ink liquid to be ejected through the first channel hole and the second channel hole by compressing the ink liquid, wherein the first plate comprises a receiving groove that is provided adjacent to the adhesive layer, and a first projection at an edge of the receiving groove that is projected toward the second plate, and the edge of the receiving groove, on which the first projection is formed, is locally deformed.

17. A recording device comprising:

the liquid ejecting head according to claim 16;

a conveying unit that conveys a recording medium to the liquid ejecting head; and a control unit that controls the liquid ejecting head.

* * * * *